US006543132B1

(12) United States Patent
Krueger et al.

(10) Patent No.: US 6,543,132 B1
(45) Date of Patent: Apr. 8, 2003

(54) METHODS OF MAKING MUD MOTORS

(75) Inventors: Volker Krueger, Celle (DE); Thorsten Regener, Burgdorf (DE); Markus Walterskoetter, Adelheidsdorf (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/213,989

(22) Filed: Dec. 17, 1998

Related U.S. Application Data

(60) Provisional application No. 60/068,090, filed on Dec. 18, 1997.

(51) Int. Cl.[7] ..... B23P 15/00

(52) U.S. Cl. ..... 29/888.023; 29/888.061; 29/509; 29/514; 29/516; 29/520; 29/521; 72/208

(58) Field of Search ..... 29/888.023, 888.061, 29/888.073, 509, 514, 516, 520, 521, 458, 460; 72/370.04, 398, 370.17, 208, 370.05, 370.23, 370.25; 427/155, 250, 304, 328, 421

(56) References Cited

U.S. PATENT DOCUMENTS

| | | | | | |
|---|---|---|---|---|---|
| 3,263,474 | A | * | 8/1966 | Pentland | |
| 3,416,346 | A | * | 12/1968 | Arrington | 72/189 |
| 3,590,622 | A | * | 7/1971 | Elge et al. | 72/209 |
| 3,606,780 | A | | 9/1971 | Nagahara | |
| 4,030,862 | A | * | 6/1977 | Larsson | 418/48 |
| 4,428,220 | A | * | 1/1984 | Rammesten | 72/370 |
| 4,852,380 | A | * | 8/1989 | Haldric et al. | 72/402 |
| 4,909,337 | A | | 3/1990 | Kochnev et al. | 175/107 |
| 4,991,292 | A | | 2/1991 | Bostel | 29/888.023 |
| 5,075,966 | A | * | 12/1991 | Mantkowski | 29/890.01 |
| 5,096,004 | A | * | 3/1992 | Ide | 175/107 |
| 5,145,342 | A | | 9/1992 | Gruber | 418/48 |
| 5,171,138 | A | * | 12/1992 | Forrest | 418/48 |
| 5,221,197 | A | * | 6/1993 | Kochnev et al. | 418/48 |
| 5,318,416 | A | * | 6/1994 | Hantschk et al. | 418/48 |
| 5,405,176 | A | * | 4/1995 | Babel et al. | 285/382 |
| 5,501,873 | A | * | 3/1996 | Ferralli | 427/195 |
| 5,638,600 | A | * | 6/1997 | Rao et al. | 29/888.02 |
| 5,692,889 | A | * | 12/1997 | Tateno et al. | 418/201.1 |
| 5,832,604 | A | * | 11/1998 | Johnson et al. | 29/888.023 |
| 6,030,371 | A | * | 2/2000 | Pursley | 604/282 |
| 6,170,572 | B1 | * | 1/2001 | Fulbright et al. | 116/68.5 |

FOREIGN PATENT DOCUMENTS

| | | |
|---|---|---|
| DE | 41 11 166 A1 | 4/1991 |
| FR | 2.155.827 | 10/1971 |
| FR | 2.299.533 | 1/1975 |

* cited by examiner

*Primary Examiner*—I Cuda Rosenbaum
(74) *Attorney, Agent, or Firm*—Madan, Mossman & Sriram, P.C.

(57) ABSTRACT

The present invention provides methods of forming mud motors. In one method, rollers are urgingly stroked against a tubular member having a mandrel therein that has an outer profile which is the inverse of the desired profile of the stator. In another method, rollers are urged and rotated radially on the tubular member with the mandrel disposed in the tubular member. In yet another method, dies are pressed against the tubular member having a mandrel with a desired outer profile. In another method, a molten metal is deposited over a mandrel with an outer lobed surface that is substantially the inverse of the desired inner profile of the stator housing. The mandrel is then removed, leaving a metallic longitudinal member having an inner profile defined by the outer profile of the mandrel. In each of these methods, the inner surface of the resulting member has the profile defined by the outer profile of the mandrel. The inner surface of the resulting member then may be coated or lined with a suitable material for the stator. A suitable rotor is then disposed in the stator to form the drilling motor.

20 Claims, 6 Drawing Sheets

METHODS OF MAKING MUD MOTORS

CROSS-REFERENCE TO RELATED APPLICATION

This application takes priority from U.S. Patent Application Serial No. 60/068,090, filed on Dec. 18, 1997.

BACKGROUND OF THE INVENTION

1. Field of the Invention

This invention relates generally to drilling or mud motors used for drilling wellbores and more particularly to methods of making such motors.

2. Description of the Related Art

To obtain hydrocarbons such as oil and gas, boreholes or wellbores are drilled by rotating a drill bit attached to a drill string end. A substantial proportion of the current drilling activity involves directional drilling, i.e., drilling deviated and horizontal boreholes, to increase the hydrocarbon production and/or to withdraw additional hydrocarbons from the earth's formations. Modern directional drilling systems generally employ a drill string having a drill bit at the bottom that is rotated by a motor (commonly referred to in the oilfield as the "mud motor" or the "drilling motor").

Positive displacement motors are commonly used as mud motors. U.S. Pat. No. 5,135,059, assigned to the assignee hereof, which is incorporated herein by reference, discloses one such mud motor. A typical mud motor includes a power section which contains a stator and a rotor disposed in the stator. The stator typically includes a metal housing which is lined inside with a helically contoured or lobed elastomeric material. The rotor is usually made from a suitable metal, such as steel, and has an outer lobed surface. Pressurized drilling fluid (commonly known as the "mud" or "drilling fluid") is pumped into a progressive cavity formed between the rotor and stator lobes. The force of the pressurized fluid pumped into the cavity causes the rotor to turn in a planetary-type motion. A suitable shaft connected to the rotor via a flexible coupling compensates for eccentric movement of the rotor. The shaft is coupled to a bearing assembly having a drive shaft (commonly referred to as the "drive sub") which in turn rotates the drill bit attached thereto. Other examples of the drilling motors are disclosed in U.S. Pat. Nos. 4,729,675, 4,982,801 and 5,074,681.

As noted above, both the rotor and stator are lobed. The rotor and stator lobe profiles are similar, with the rotor having one less lobe than the stator. The difference between the number of lobes on the stator and rotor results in an eccentricity between the axis of rotation of the rotor and the axis of the stator. The lobes and helix angles are designed such that the rotor and stator lobe pair seal at discrete intervals. This results in the creation of axial fluid chambers or cavities which are filled by the pressurized circulating fluid. The action of the pressurized circulating fluid causes the rotor to rotate and precess within the stator.

The rotor typically is made of a material such as steel and has an outer contoured surface which is relatively easily to manufacture with precision. The stator, however, has an inner lobed surface and is made of an elastomeric material, typically by an injection molding process. The thickness of the elastomer varies with the contour of the lobes. Manufacturing of stators requires detailed attention to elastomer composition, consistency, bond integrity and lobe profile accuracy. The stators of relatively large mud motors can be several feet long. Because of the stator's physical characteristics (length, lobe profile, etc.) and the precision required, stators are frequently made by joining smaller sections. Such manufacturing processes are time consuming, expensive and offer few flexibilities. Also, since the elastomeric layer is typically non-uniform, it exhibits uneven heat dissipation and wear characteristics.

Stators with relatively thin and uniform elastomeric layers tend to perform better and have longer operating lives than those of non-uniform elastomeric stators described above. In some applications, completely metallic stators or having a non-elastomeric layer, such as a ceramic layer, may be preferred.

The present invention addresses certain problems with the prior art methods of making mud motors and provides methods for manufacturing mud motors, wherein the stator is made as a continuous member with inner surface having a desired profile, which is then lined with a substantially uniform layer of a suitable material such as an elastomeric or ceramic material. The methods of the present invention are efficient and cost effective.

SUMMARY OF THE INVENTION

The present invention provides methods of manufacturing mud motors. The motor includes a stator and a rotor which is rotatably disposed in the stator. In one method, to form the stator, a mandrel whose outer surface substantially corresponds to the inverse of the desired inner profile of the stator is disposed inside a metal tubular member. The mandrel has a slightly tapered end for easy retrieval from the tubular member. The metal tubular member with the mandrel therein is placed between at least two rollers disposed on opposite sides of the tubular member. The rollers, while urging against the tubular member, rotate in opposite directions (one clockwise and the other counter-clockwise), thereby moving on the tubular member in the same direction. These rollers rotate back and forth thereby stroking over the tubular member. This stroking motion reduces the outer dimensions of the tubular member. The tubular member is rotated about its longitudinal axis while the rollers stroke. The process is continued until the inside of the tubular member attains the profile defined by the outer profile of the mandrel. After a section of the tubular member is formed, the tubular member is moved axially to form the next section The inside of the tubular member is then lined with a suitable material, such as an elastomer or a ceramic material. A suitable rotor having a desired outer lobed surface is then rotatably disposed in the stator to form the motor.

In an alternative method for manufacturing the mud motor, the stator is formed by compressing a tubular member by a plurality of continuously rolling rollers. A mandrel whose outer surface corresponds to the inverse of the desired inner profile of the stator is placed inside a metal tubular member. The mandrel has a slightly tapered surface for easy retrieval from the tubular member. A plurality of rollers are urged against the tubular member while rotating in a common direction, thereby rotating the tubular member in the direction opposite that of the rollers. This rolling action reduces the outer dimensions of the tubular member. The process is continued until the inside of the tubular member attains the desired profile.

In yet another method of forming a stator, a tubular member having therein a mandrel with an outer contoured surface is alternately pressed with a plurality of dies disposed around the tubular member's outer surface, thereby reducing the outside dimensions of the tubular member. The process is continued until the inside surface of the tubular member attains the profile defined by the mandrel. The tubular member inside is lined with a suitable elastomer.

In still another method of making a mud motor, a mandrel is formed with a contoured outer surface that substantially corresponds to the inverse of the desired inner profile of the stator. The contoured outer surface of the mandrel is made of a frangible material, such as ceramic. The mandrel is designed to account for the load and shrinkage of the formed section of the stator. The mandrel is sprayed with a suitable metal to a desired thickness to form a tubular member. The mandrel is then removed from the tubular member. The resulting tubular member has the desired inside profile of the stator which is then lined with an elastomeric material.

In each of the methods described above, the elastomeric material is preferably injection molded over the inner surface of the tubular member. Alternatively, the rotor may have an outer elastomeric or ceramic layer or both the rotor and stator may have metal-to-metal contacting surfaces.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawings, in which like elements have been given like numerals and wherein.

DESCRIPTION OF THE PREFERRED EMBODIMENT

The present invention provides methods of making mud motors. In general, the stator is made according to the methods of this invention. A suitable rotor is disposed in the stator to form the mud motor. Before describing the methods of making the mud motors according to the present invention, it is considered helpful to first describe an example of a commonly utilized mud motor for drilling oilfield wellbores.

Figure 1A:
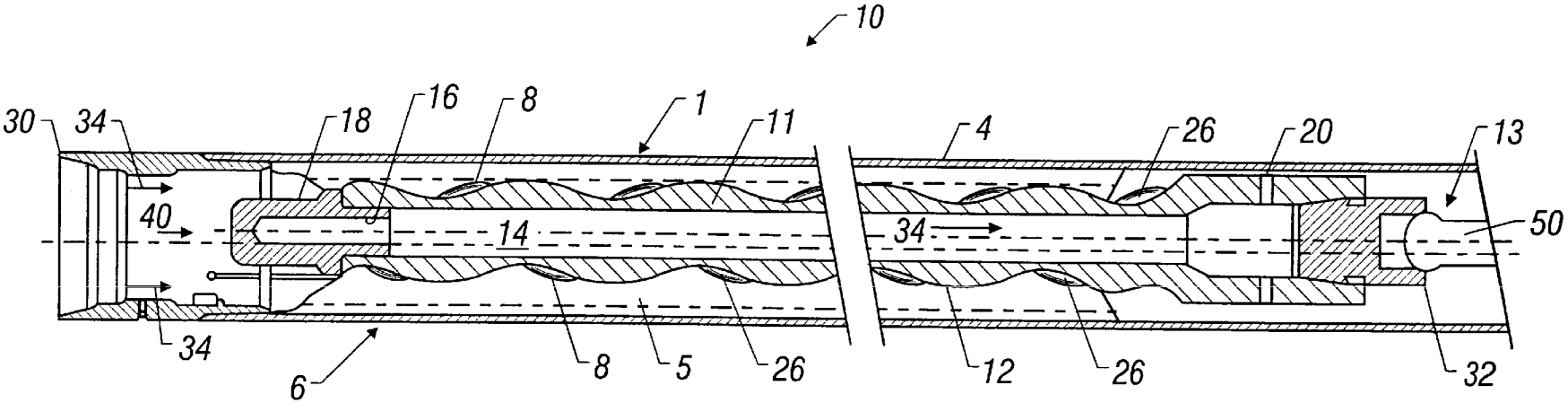
FIGS. 1A and 1B show a longitudinal cross-section of a mud motor.
Figure 1B:
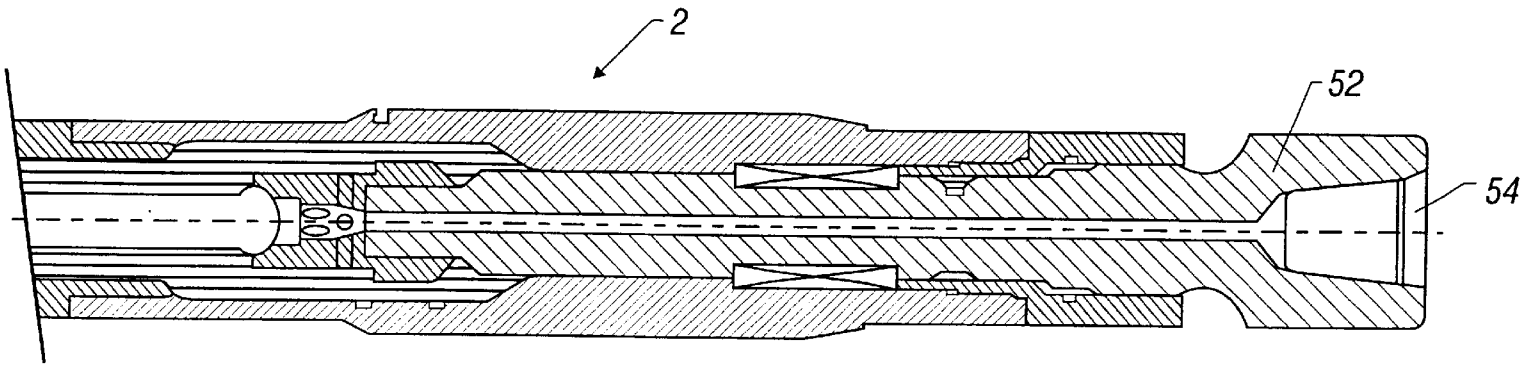

FIGS. 1A–1B show a cross-sectional elevation of a positive displacement motor 10 having a power section 1 and a bearing assembly 2. The power section 10 contains an elongated metal housing 4, having therein an elastomeric member 5 which has a helically-lobed (lobed) inner surface 8. The elastomeric member 6 is secured inside the housing 4, usually by bonding the elastomeric member 5 within the interior of the housing 4. For the purposes of this disclosure, the combination 6 or the assembly of the elastomeric member 5 and the housing 4 is referred to herein as the "stator."

A rotor 11, preferably made from steel, having a helically-lobed outer surface 12, is rotatably disposed inside the stator 6. The rotor 11 preferably has a non-through bore 14 that terminates at 16 below the upper end 18 of the rotor 11 as shown in FIG. 1A. The bore 14 remains in fluid communication with the drilling mud 40 below the rotor 11 via a port 20. Both the rotor lobe 12 and the stator lobe 8 profiles are similar, with the rotor 11 having one less lobe than the stator 6. The rotor lobes 12 and the stator lobes 8 and their helical angles are such that the rotor 11 and the stator 6 seal at discrete intervals resulting in the creation of axial fluid chambers or cavities 26 which are filled by the pressurized drilling fluid 40.

The action of the pressurized circulating drilling mud 40 flowing from the top 30 to the bottom 32 of the power section 1, as shown by arrow 34, causes the rotor 11 to rotate within the stator 6. Modification of lobe numbers and geometry provide for variation of motor 10 input and output characteristics to accommodate different drilling operations requirements. The rotor 6 is coupled to a flexible shaft 50, which connects to a rotatable drive shaft 52 in the bearing assembly 2 that carries the drill bit (not shown) in a suitable bit box 54.

Figure 2A:
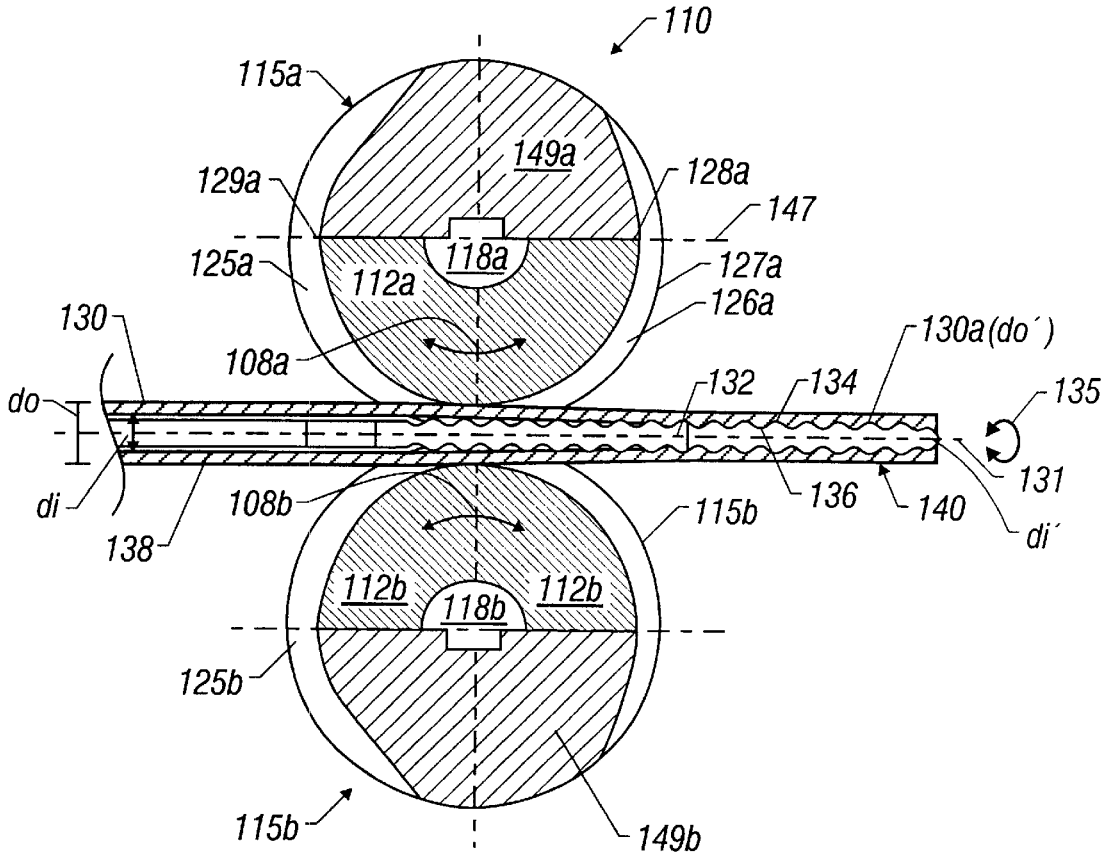
FIGS. 2A and 2B show elevational views of a preferred system for making the stator housing according to one method of the present invention.
Figure 2B:
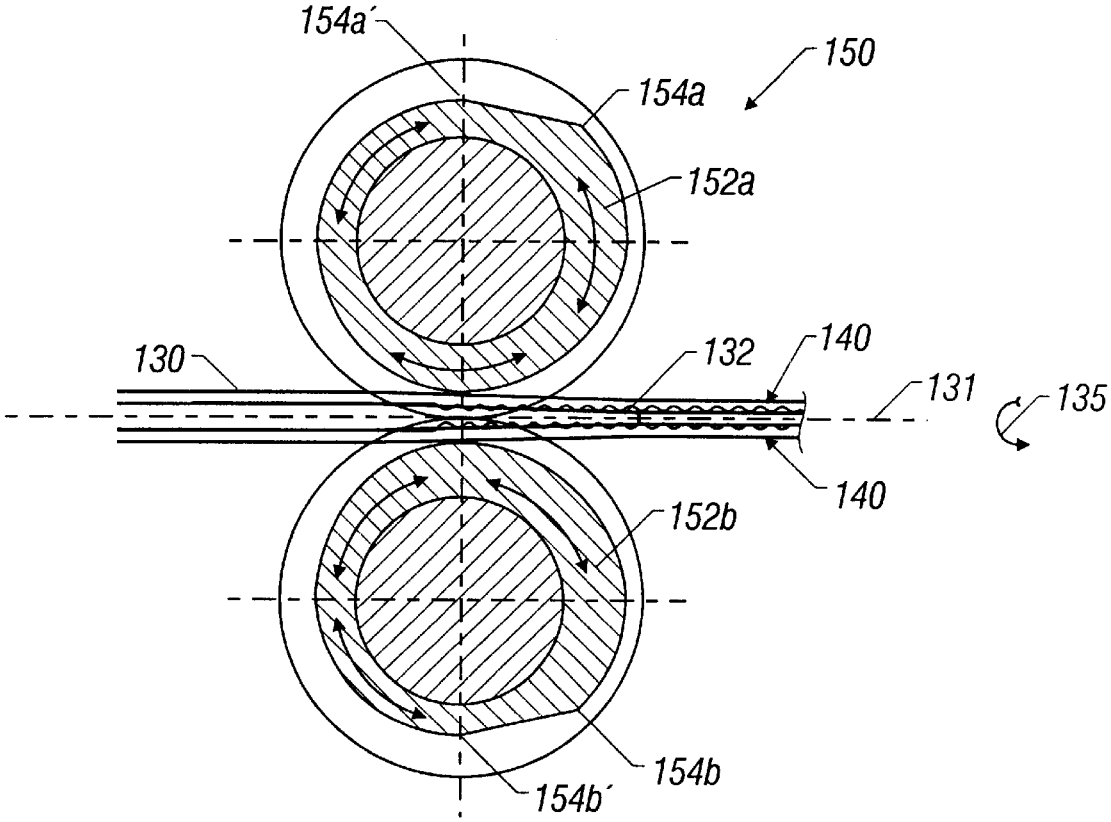

The methods of making mud motors according to the present invention will now be described with reference to FIGS. 2A–6A. FIG. 2A shows a method of making a stator by what is referred to herein as the "short stroke" rolling process or method 110. FIG. 2B shows a method of making a stator by what is referred to herein as the "long stroke" rolling process or method 150. To make a stator, such as stator 6 of FIG. 1A, a rigid mandrel 132 is disposed in a tubular member 130 made from a suitable material, such as steel. Tubular member 130 has initial outside and inside diameters of $d_o$ and $d_i$ respectively. The mandrel 132 has an outer contoured surface 134, which corresponds to the inverse of the desired contour of the finished stator housing 140. The mandrel 132 is tapered from the front end 138 to the terminating end 136, with the outer dimensions at the end 136 being less than those at the end 138. Tapered mandrel 132 enables easy removal of the mandrel 132 from the finished stator housing 140.

To form the stator housing 140, the tubular member 130 with the mandrel 132 suitably disposed therein is placed between rollers 115*a* and 115*b* of the system 110. The rollers 115*a* and 115*b* are substantially identical and, therefore, the construction of only the roller 115*a* is described herein. The roller 115*a* includes a roller die 112*a* that strokes or reciprocates in the directions shown by the arrow 108*a*. The roller 115*a* urges against the tubular member 130 as it strokes over the tubular member 130. A caliper section 125*a* defines the travel (depth) of the roller die 112*a* toward the tubular member 130. The clearance 126*a* between the roller die 112*a* and the periphery 127*a* of the caliper section 125*a* increases from the roller die end 128*a* to the roller die end 129*a*, which enables the roller die 112*a* to travel to a greater depth at the end 128*a* than the end 129*a*. Element 149*a* defines the axis 147 of the movement of the roller die 112*a*. As noted above, the roller 115*b* is identical to the roller 115*a*, in that it has a roller die 112*b*, a roller caliper section 125*b*, and a pivot 118*b*. The roller 115*b* reciprocates along the pivot 116*b* in the directions shown by the arrows 108*b* in the same direction as the die 112*a*.

In operations, the roller dies 112*a* and 112*b* urge against the tubular member 130 and respectively reciprocate (or stroke) over the tubular member 130 along the longitudinal axis 131 of the tubular member 130. The roller dies 112*a* and 112*b* travel to greater depths when they stroke toward ends 128*a* and 128*b* respectively compared to the ends 129*a* and 129*b*. The stator housing 140 therefore finishes toward the right side of FIG. 2A. The tubular member 130 also step wise rotates about its longitudinal axis 131 as shown by arrows 135. The roller dies 112*a* and 112*b* compress the tubular member 130 toward the mandrel 132. As this process continues, the inside of the tubular member 130 presses against the mandrel 132 and starts to acquire the lobed contour 134 of the mandrel 132. Continuing the process causes the tubular member inside 134 to attain the lobed contour with diameter $d_i'$. The outer surface 130*a* retains a tubular form with the diameter $d_o'$, which is less than the original diameter $d_o$ of the tubular member 130. As a portion of the tubular member 130 is formed to the required dimensions, the tubular member 130 is advanced to continue forming the remaining portion of the tubular member 130 into the desired form. A continuous stator housing 140 of any suitable length can be made by this method. The process 110 may be hot-rolled or cold-rolled. Relatively precise stators can be formed with the cold-rolled process. Such stator housings 140 require relatively little or no further machining.

FIG. 2B is a schematic illustrating the long stroke method 150 of making the stator housing 140. The process 150 of FIG. 2B differs from the process shown in FIG. 2A in that the roller dies 152*a* and 152*b* have longer strokes compared to the strokes of the roller dies 112*a* and 112*b* of FIG. 2A. As seen in FIG. 2B the stroke of the roller die 152*a* is defined by the distance between points 154*a* and 154*a*' while the stroke of the roller die 152*b* is defined by the distance between 154*b* and 154*b*'. Otherwise the process 150 of FIG. 2A is similar to that of the process 110 of FIG. 2A. After the stator housing 140 has been formed to a sufficient length, it is cut to the desired length.

Figure 3:
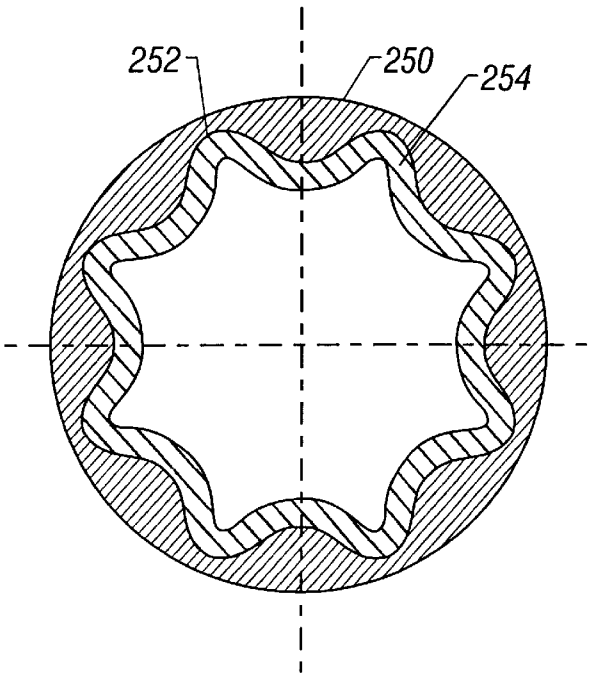
FIG. 3 shows a cross-section of the stator housing made by the methods of the present invention.

FIG. 3 shows the cross-section of an exemplary stator housing 250 made according to the processes shown in FIGS. 2A and 2B. The stator housing 250 is shown to have a desired inner contoured profile. The stator housing 250 is then lined with a suitable elastomeric material 254, preferably by a suitable injection molding process. Due to the relatively uniform inner profile 252 of the stator, the elastomeric liner 252 is of uniform thickness (relatively) compared to the varying thickness elastomeric liner 5 shown in FIG. 1A. Relatively thin uniform thickness stator liners allow uniform heat dissipation. Metals, such as steel, utilized for making the stator housing 250, are excellent heat dissipators compared to elastomers.

Figure 4:
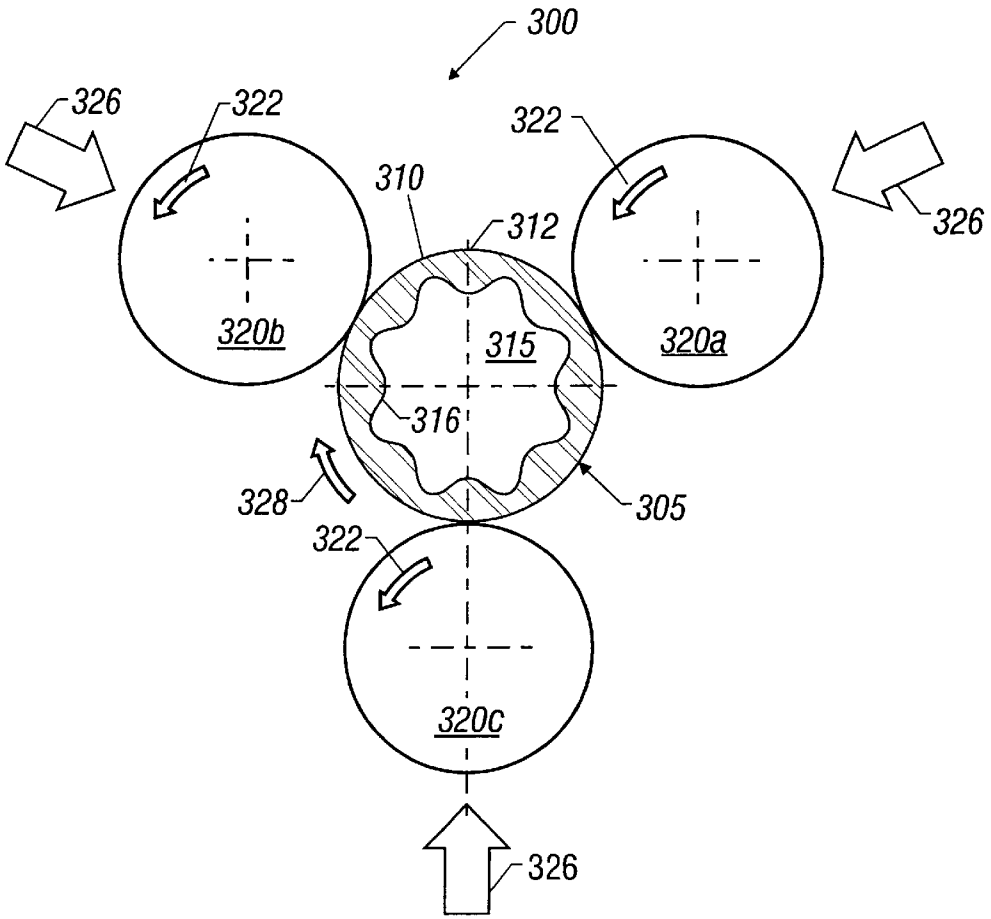
FIG. 4 show an elevational view of a rotary system for making the stator housing according to one method of the present invention.

FIGS. 4 shows a rolling process 300 for forming a stator housing 310 having an inner lobed profile 312 according to one of the methods of the present invention. The system 300 includes a plurality of radially disposed rollers 320*a*, 320*b* and 320*c*. Each such roller is adapted to rotate in a common direction, i.e., clockwise or counterclockwise. As an example, the rollers 320*a*–320*c* are shown rotating counterclockwise as shown by the arrows 322. To form the stator housing 310, a tubular member 305 with initial desired inner and outer diameters, is fed between the rollers 320*a*–320*c*. Each roller 320–320*c* urges against or exerts pressure on the tubular member 310 as shown by arrows 326 while the rollers 320*a*–320*c* rotate. A mandrel 315 having a lobed outer surface 316 is disposed in the tubular member 305. The profile of the surface 312 is reverse of the desired inner profile of the finished stator housing 310. The mandrel 315 is tapered as described above with reference to FIG. 1A for easy retrieval of the mandrel 315 from the finished stator housing 310.

To form the stator housing 310, the metallic tubular member 305 containing the metallic mandrel 315 is placed between the rollers 320*a*–320*c*. The rollers 320*a*–320*c* rotate in the direction 322 while urging against the tubular member 305 in the direction 326. The action of the rotors 320*a*–320*c* rotates the tubular member 305 in the direction 328 and gradually reduces the overall diameter of the tubular member 305. This action causes the inside of the tubular member 305 to attain a profile defined by the outer profile 312 of the mandrel 315. When a portion of the tubular member 305 attains the desired inner profile and the outer dimensions, the tubular member 305 is advanced with the mandrel remaining at its position to continue the process of forming the stator housing 310. Accordingly, the method 300 enables transforming a continuous tubular member 305 into a stator housing of any desired length. The stator housing 310 is then cut to the desired length and lined with a suitable elastomeric material as described above with respect to FIG. 3. The rolling process 300 of FIG. 4 is continuous. It may be a cold-rolled or hot-rolled process. The cold-rolled process is preferred because it can be controlled to produce relatively precision-finished stator housings 310, which usually do not require additional machining steps. The hot-rolled process utilizes a hot tubular member. This process is faster than the cold-rolled process, but it is more difficult to control and, in certain cases, the finished stator housing 310 may require additional machining operations.

Figure 5:
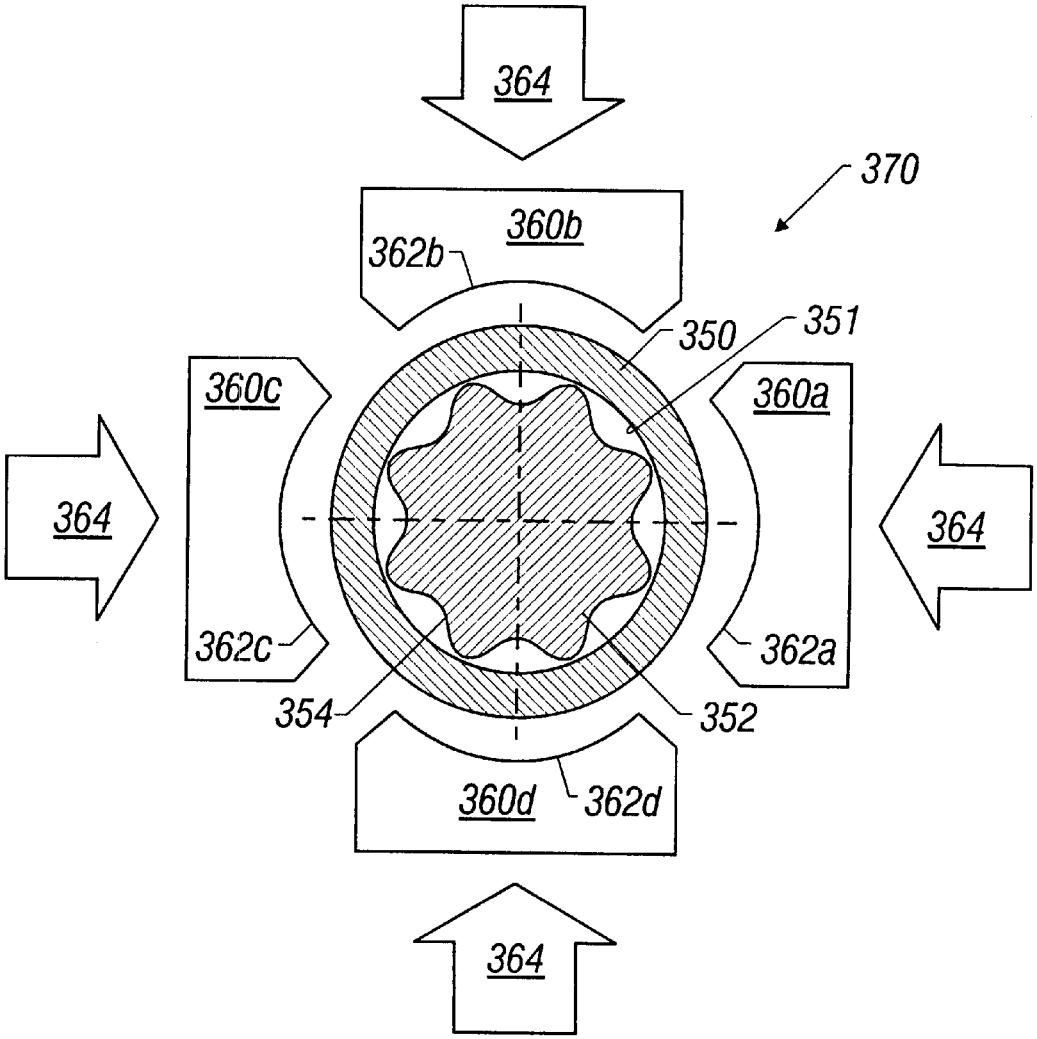
FIG. 5 shows an elevational view of a swaging process for making the stator housing according to one method of the present invention.

FIG. 5 shows an elevational view of a rotary swaging process 370 for making the stator housing according to one method of the present invention. A tubular member 350 having a mandrel 352 with a desired outer profile 354 is placed between a plurality of conforming blocks 360*a*–360*d*. Each of the blocks 360*a*–360*c* has corresponding concave interior surfaces 362*a*–362*c*. To form the stator housing, the blocks 360*a*–360*c* are alternately urged against the tubular member 350, i.e., in the directional shown by arrows 364 and moved away from the tubular member 350. The tubular member 350 or the blocks 360*a*–360*c* or both may be rotated as desired. As this process continues, the outside and inside diameters of the tubular member 350 continue to reduce, eventually causing the inside 350*a* of the tubular member 350 to attain the profile defined by the outer profile 354 of the mandrel 352. When a section of the tubular member 350 is formed into the desired shape, the tubular member 350 is advanced (moved forward) and the process continued. The mandrel is tapered for easy removal from the tubular member. The finished stator housing is then lined inside with an elastomeric material as described above with respect to FIG. 3.

Figure 6:
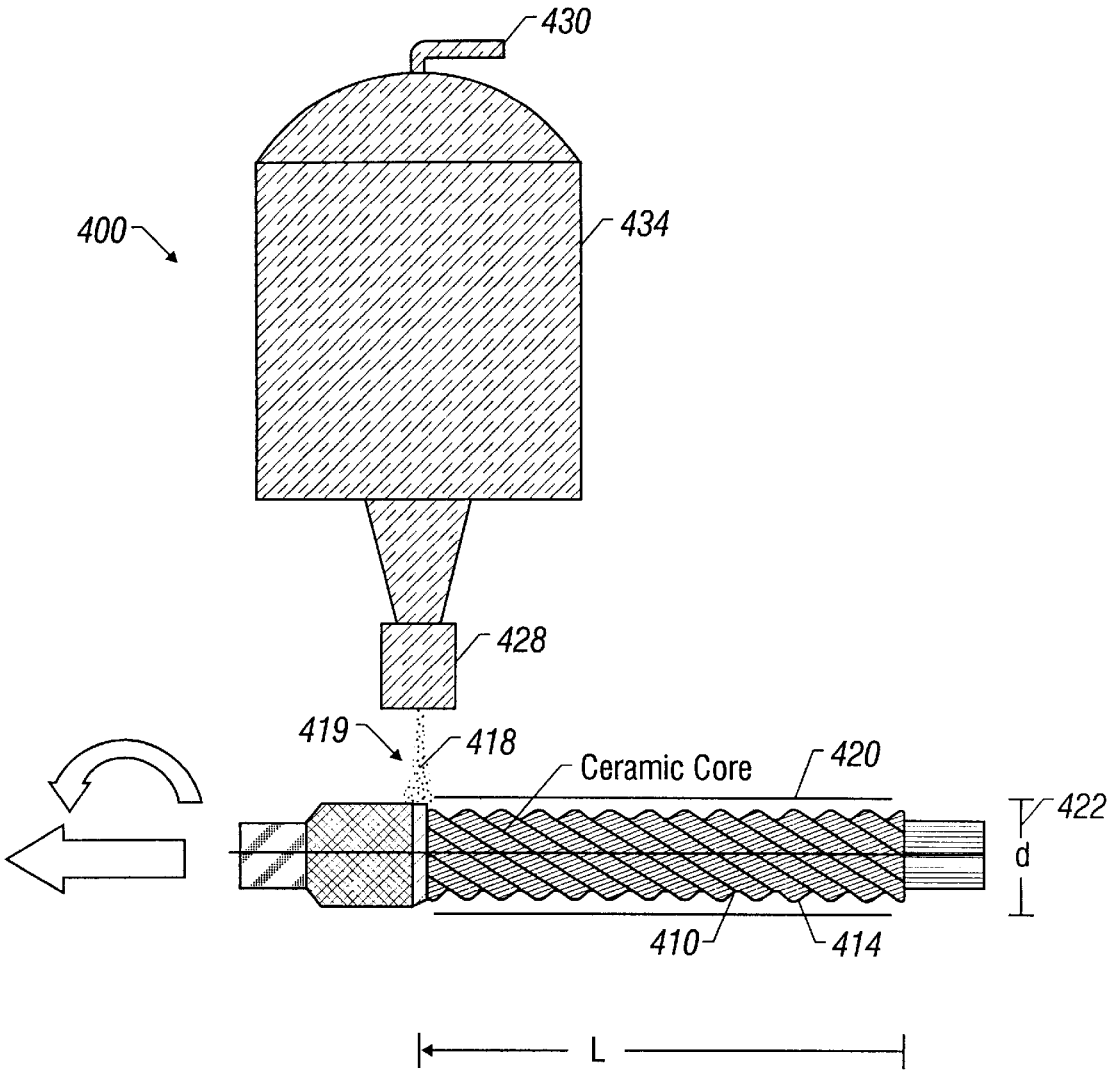
FIG. 6 shows an elevational view of a spraying process for making the stator housing according to one method of the present invention.

FIG. 6 shows an elevational view of a spray forming process for making the stator housing 420 according to one method of the present invention. A mandrel 410 with a predetermined length "L" and an outer profile 414 is fabricated by any known method. The mandrel 414 is made from a frangible material such as ceramic. Alternatively, the mandrel 414 may be made of any stiff material with an outer layer made from a frangible material. The mandrel 414 is then uniformly sprayed with a suitable metal material 418 until it attains a desired diameter "d" 422. In the preferred method, a gas-atomized stream 419 of a suitable molten metal is sprayed on the rotating and advancing mandrel 410. The sprayed metal 418 rapidly solidifies. The stator housings 420 made by the spray forming process 400 are usually fine grained and substantially free from segregation effects.

The spray forming process 400 is preferably achieved by gas-atomizing the molten metal 418 from a source 434 thereof into a spray 419 and depositing the spray 419 on the mandrel 410. The deposition rate of the spray 429 is preferably controlled by a vacuum system 430. This allows forming a layer of semi-solid/semi-liquid metal of controlled thickness. After the stator housing 420 has been formed, the mandrel is dislodged from within the stator housing 420 by discarding the frangible material. The inner surface 414 of the stator housing 410 is then lined with a suitable material as described in reference to FIG. 3. The material 418 may be sprayed in the form of layers, wherein adjacent layers having the same or different material. For example the first layer may be of tungsten carbide and the next layer may be of steel. The choice of materials will depend upon the physical characteristics desired of the finished product, such as ductility and strength.

Figure 6A:
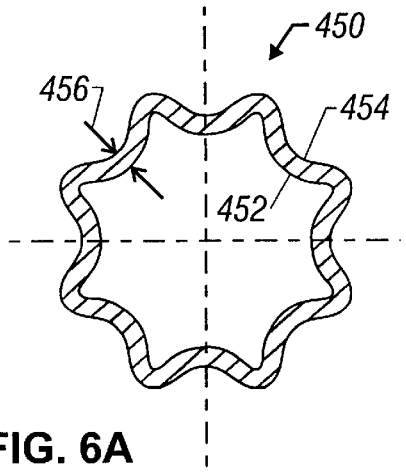
FIG. 6A is a cross-section of a mandrel for use in the process of FIG. 6.
Figure 6B:
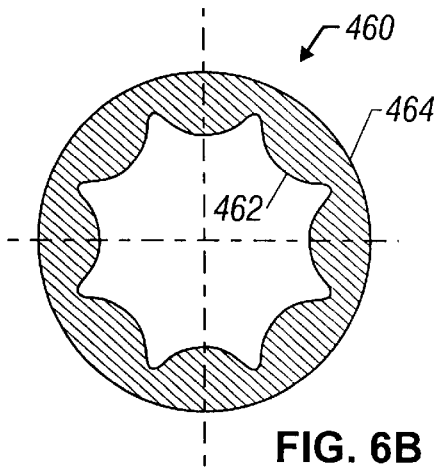
FIG. 6B is a cross-section of a mandrel for use in the process of FIG. 6.

Alternatively, the mandrel 410 may be made as a hollow liner 440 having the inner dimensions and profile 442 desired of the finished stator housing 420. FIG. 6A shows a cross-section of a hollow mandrel 450 for use in the spray method 400 of FIG. 6. The mandrel 450 has an inner surface 452 that defines the contour of the stator inside. The outer surface 454 may be of any type. The mandrel thickness 456 may be relatively small. FIG. 6B shows a cross-section of a mandrel 460 that has the inner profile 462 that defines the inner profile of the stator and has a tubular outer profile 464. The mandrels 450 and 460 are relatively inexpensive and easy to make. The inside surface of the mandrels 450 and 460 may be made in the finished form of the stator inside prior to or after the spraying of the mandrels with the suitable material. This may be lined with a suitable elastomer or may be a metallic surface.

The stator housing made by any of the methods of the present invention may be coated or lined with any suitable material, including an elastomeric material, a thermo-plastic material, a ceramic material, and a metallic material. Any suitable method or process may be utilized to apply such materials to the stator housing. The processes utilized may include a galvanic deposition process, (ii) an electrolytic deposition process, (iii) a molding process, (iv) a baking process, (v) a plasma spray process, and (vi) a thermo-set process. The process utilized will depend upon the type of the material selected. The rotor may also be lined with a suitable material or rotor and stator may have metal-to-metal contacting surfaces.

The foregoing description is directed to a particular embodiment of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A method of making a stator housing having a desired inner profile and with a substantially uniform outer diameter for use in drilling wellbores, comprising:

(a) providing a metallic hollow tubular member that is to be transformed to a stator housing having an inner surface and the desired inner profile along an axial direction of the metallic hollow tubular member, the desired profile including at least one lobe:

(b) placing a mandrel inside the metallic hollow tubular member, said mandrel having an outer contoured surface that corresponds to the desired inner profile of the stator housing; and (c) applying compressive force on the outside an outer surface of the metallic hollow tubular member by at least two rollers to compress the metallic hollow tubular member toward the mandrel to reduce the overall outer diameter of the metallic hollow tubular member until the inner surface of the metallic hollow tubular member attains the profile defined by the outer profile of the mandrel and the outer surface is substantially uniform in diameter.

2. The method of claim 1 further comprising applying on the inner surface of the stator housing a secondary material that is different from the material of the metallic hollow tubular member.

3. The method of claim 1, wherein the at least two rollers stroke over the metallic hollow tubular member along the axial direction.

4. The method of claim 3, wherein each said roller travels a varying distance toward the hollow metallic tubular member during each said stroke.

5. The method of claim 4 further comprising rotating the metallic hollow tubular member while said at least two rollers are applying compressive force on the metallic hollow tubular member.

6. The method of claim 2 wherein applying the secondary material includes selecting the secondary material from a group consisting of (i) a ceramic material, and (ii) a metallic material.

7. The method of claim 2 wherein applying the secondary material includes applying said secondary material on the inner surface of the stator housing by one of (i) a galvanic deposition process, (ii) an electrolytic deposition process, and (iii) a plasma spray process.

8. The method of claim 2 wherein applying the secondary material includes applying at least two layers.

9. The method of claim 8 wherein one of said at least two layers is a resin material for bonding said secondary material to the stator housing.

10. The method of claim 2 wherein said applying on the inner surface includes applying said secondary material of substantially uniform in thickness.

11. The method of claim 1, further comprising disposing a rotor having an outer contoured surface within said stator to form a drilling motor.

12. The method of claim 1, wherein said at least two rollers rotate in same direction radially over the metallic hollow tubular member.

13. The method of claim 1 further comprising rotating the tubular member while a plurality of rollers compress the tubular member.

14. A method of making a stator for a drilling motor for drilling wellbores, comprising:

(a) defining an inner profile having a lobe;

(b) defining an outer profile having a substantially uniform outer diameter;

(c) placing a mandrel inside a hollow tubular member having an inner and outer surface, the mandrel having an outer contoured outer surface that corresponds to the inner profile; and (d) compressing the outer surface of the hollow tubular member toward the mandrel until the inner surface of the tubular member attains substantially the defined inner profile and the outer surface of the tubular member attains a substantially uniform outer diameter, a stator thereby being formed.

15. The method of claim 14 further comprising applying on the inner surface of the stator a secondary material that is different from a material forming the hollow tubular member.

16. The method of claim 15 wherein the second material is selected from a group consisting of (i) an elastomeric material, (ii) a thermo-plastic material, (iii) a ceramic material, and (iv) a metallic material.

17. The method of claim 14, wherein a plurality of force application members stroke over the hollow tubular member along a longitudinal axis of the hollow tubular member to compress the outer surface of the hollow tubular member.

18. The method of claim 17, wherein said force application members include rollers that travel a varying distance toward the hollow tubular member during each stroke.

19. The method of claim 14, further comprising disposing a rotor having an outer contoured surface within the stator to form the drilling motor.

20. The method of claim 14 wherein a plurality of swaging devices substantially simultaneously urge against the outer surface of said hollow metallic tubular member to compress the hollow tubular member toward the mandrel to form the stator housing.

* * * * *